US008925975B2

(12) United States Patent
Granger et al.

(10) Patent No.: US 8,925,975 B2
(45) Date of Patent: Jan. 6, 2015

(54) SET FOR PRODUCING A THREADED CONNECTION FOR DRILLING AND OPERATING HYDROCARBON WELLS, AND RESULTING THREADED CONNECTION

(75) Inventors: Scott Granger, Valenciennes (FR); Olivier Caron, Ramecourt (FR); Eric Verger, Gommegnies (FR)

(73) Assignees: Vallourec Oil and Gas France, Aulnoye-Aymeries (FR); Sumitomo Metal Industries, Ltd., Osaka-shi (JP)

( * ) Notice: Subject to any disclaimer, the term of this patent is extended or adjusted under 35 U.S.C. 154(b) by 534 days.

(21) Appl. No.: 13/319,410

(22) PCT Filed: May 3, 2010

(86) PCT No.: PCT/EP2010/002682

§ 371 (c)(1), (2), (4) Date: Nov. 8, 2011

(87) PCT Pub. No.: WO2010/130344

PCT Pub. Date: Nov. 18, 2010

(65) Prior Publication Data

US 2012/0049514 A1 Mar. 1, 2012

(30) Foreign Application Priority Data

May 12, 2009 (FR) ..... 09 02276

(51) Int. Cl.
*F16L 15/06* (2006.01)
*E21B 17/042* (2006.01)

(52) U.S. Cl.
CPC ..... *E21B 17/042* (2013.01)
USPC ..... 285/334; 285/333

(58) Field of Classification Search
USPC ..... 285/333–334, 355, 390
See application file for complete search history.

(56) References Cited

U.S. PATENT DOCUMENTS 4,582,348 A 4/1986 Dearden et al.
4,629,223 A 12/1986 Dearden et al.

(Continued)

FOREIGN PATENT DOCUMENTS

FR 2 551 527 3/1985
JP 08-511313 A 11/1996
JP 10-504880 A 5/1998

OTHER PUBLICATIONS

International Search Report Issued Aug. 13, 2010 in PCT/EP10/002682 Filed May 3, 2010.

(Continued)

*Primary Examiner* — Aaron Dunwoody
*Assistant Examiner* — Fannie Kee
(74) *Attorney, Agent, or Firm* — Oblon, Spivak, McClelland, Maier & Neustadt, L.L.P.

(57) ABSTRACT

A threaded connection includes first and second tubular components each with an axis of revolution. The first component including a male threaded end, the second component including a female threaded end, and both the male and female threaded ends finishing in a terminal surface. The threaded zones include, over a portion defined as in a self-locking make-up, threads, which before the self-locking make-up and when viewed in a longitudinal section passing through the axis of revolution of the first and second components, each include: a thread crest, a thread root, a load flank, and a stabbing flank. A width of the thread crests of each component reducing in a direction of the terminal surface of the component under consideration, while a width of the thread roots increases. A lead of the male stabbing flanks and/or load flanks is different from a lead of the female stabbing flanks and/or load flanks.

11 Claims, 4 Drawing Sheets

(56) References Cited

U.S. PATENT DOCUMENTS

| | | | | |
|---|---|---|---|---|
| 5,454,605 | A | 10/1995 | Mott | |
| 6,155,613 | A | 12/2000 | Quadflieg et al. | |
| 6,817,099 | B2 * | 11/2004 | Watts | 29/890.14 |
| 2001/0001219 | A1 * | 5/2001 | Dawson | 285/334 |
| 2006/0145477 | A1 | 7/2006 | Reynolds | |
| 2007/0132239 | A1 | 6/2007 | Reynolds | |
| 2007/0176423 | A1 * | 8/2007 | Reynolds et al. | 285/334 |
| 2007/0216160 | A1 | 9/2007 | Reynolds | |
| 2008/0084060 | A1 * | 4/2008 | Reynolds, Jr. | 285/47 |
| 2010/0156099 | A1 | 6/2010 | Reynolds | |
| 2010/0171305 | A1 | 7/2010 | Roussie et al. | |

OTHER PUBLICATIONS

U.S. Appl. No. 13/260,138, filed Oct. 7, 2011, Granger, et al.
U.S. Appl. No. 13/319,130, filed Nov. 17, 2011, Granger, et al.

* cited by examiner

SET FOR PRODUCING A THREADED CONNECTION FOR DRILLING AND OPERATING HYDROCARBON WELLS, AND RESULTING THREADED CONNECTION

The present invention relates to a set for producing a threaded connection for drilling and operating hydrocarbon wells, the set comprising a first and a second tubular component one being provided with a male type threaded end and the other being provided with a female type threaded end, the two ends being capable of cooperating by self-locking make-up. The invention also relates to a threaded connection resulting from connecting two tubular components by make-up.

The term "component used for drilling and operating hydrocarbon wells" means any element with a substantially tubular shape intended to be connected to another element of the same type or not in order, when complete, to constitute either a string for drilling a hydrocarbon well or a riser for maintenance such as a work over riser, or a thick wall casing string or tubing string involved in operating a well. The invention is of particular application to components used in a drill string such as drill pipes, heavy weight drill pipes, drill collars and the parts which connect pipes and heavy weight pipes known as tool joints.

In known manner, each component used in a drill string generally comprises an end provided with a male threaded zone and/or an end provided with a female threaded zone each intended to be connected by make-up with the corresponding end of another component, the assembly defining a connection. The string constituted thereby is driven from the surface of the well in rotation during drilling; for this reason, the components have to be made up together to a high torque in order to be able to transmit a rotational torque which is sufficient to allow drilling of the well to be carried out without break-out or even over-torquing.

In conventional products, the make-up torque is generally achieved thanks to cooperation by tightening of abutment surfaces provided on each of the components which are intended to be made up. However, because of the fact that the extent of the abutment surfaces is a fraction of the thickness of the tubes, the critical plastification threshold of the abutment surfaces is reached rapidly when too high a make-up torque is applied.

For this reason, threadings have been developed which can relieve the abutment surfaces of at least a portion or even all of the loads which they are not capable of taking up. The aim was achieved by using self-locking threadings such as those described in the prior art document US Re 30 647 and US Re 34 467. In this type of self-locking threads, the threads (also termed teeth) of the male end and the threads (also termed teeth) of the female end have a constant lead but the thread widths are variable.

More precisely, the widths of the thread crests (or teeth) increase progressively for the threads of the male end, respectively the female end, with distance from the male end, respectively from the female end. Thus, during make-up the male and female threads (or teeth) finish up locking into each other in a position corresponding to a locking point. More precisely, locking occurs for self-locking threadings when the flanks of the male threads (or teeth) lock against the flanks of the corresponding female threads (or teeth). When the locking position is reached, the male and female threaded zones made up into each other have a plane of symmetry along which the width at the common mid-height of the male and female teeth located at the end of the male threaded zone corresponds to the width at the common mid-height of the male and female teeth located at the end of the female threaded zone.

For this reason, the make-up torque is taken up by almost all of the contact surfaces between the flanks, i.e. a total surface area which is much larger than that constituted by the abutment surfaces of the prior art.

However, the need to make the threaded zones of that type of connection tight by imposing a contact between the flanks and between the thread crests and the thread roots renders the make-up operation complex when a lubricant is used. Before assembling the connections, a lubricating film is applied to the threaded zones of the male end (also termed the pin), of the female end (also termed the box) or to both. This lubricating film is normally much thicker than necessary. Thus, as the connection is being assembled, excess lubricant flows across the threaded zones and then is evacuated at the outer shoulder of the male tubular component or at the inner shoulder of the female tubular component. However, in the case in which the threads are in tightening contact at the thread crests and roots and at the flanks, the lubricant is trapped under pressure. For this reason, a false reading of the make-up torque is obtained. Then, once in service under an insufficient make-up torque, the connection may no longer be tight and the excess pressurized lubricant may escape.

Developments have been made to overcome these disadvantages. Documents U.S. Pat. Nos. 6,050,610 and 7,350,830 propose introducing a groove onto the threads in order to evacuate the lubricant. However, the presence of grooves weakens the fatigue strength and compromises the seal. Other solutions have been envisaged, such as those proposed in document US 2007/0216160. The principle is to create perturbations in the threaded zones so that the contact pressure between the threads be cancelled out in certain portions, in particular to allow the lubricant to move around, thereby avoiding the problem of over-pressure. However, such configurations are problematic in that inspection of the threaded zones is rendered complex. It is in fact necessary to ascertain whether the perturbation is planned or whether it is a machining error. Further, the reduction in contact pressure in a given zone must be compensated for by an increase in contact pressure in a neighbouring zone. This then gives rise to risks of galling.

For this reason, the aim of the invention is to facilitate evacuation of excess lubricant during make-up without compromising the tightening of the connection or its fatigue strength.

More precisely, the invention concerns a set for producing a threaded connection, comprising a first and a second tubular component each with an axis of revolution, one of their ends being provided with a threaded zone formed on the external or internal peripheral surface of the component depending on whether the threaded end is of the male or female type, said ends finishing in a terminal surface which is radially orientated with respect to the axis of revolution of the tubular components, said threaded zones comprising threads comprising, viewed in longitudinal section passing through the axis of revolution of the tubular components, a thread crest, a thread root, a load flank and a stabbing flank, the width of the thread crests of each tubular component reducing in the direction of the terminal surface of the tubular component under consideration, while the width of the thread roots increases, characterized in that the lead of the male stabbing flanks and/or load flanks is different from the lead of the female stabbing flanks and/or load flanks.

Optional complementary or substitutional features of the invention are described below.

The lead of the male stabbing flanks and/or load flanks is strictly smaller than the lead of the female stabbing flanks and/or load flanks, the thickness of the male tubular component $e_p$ at the end of the threaded zone being less than the thickness of the female tubular component $e_b$.

The lead of the male stabbing flanks and/or load flanks is strictly greater than the lead of the female stabbing flanks and/or load flanks, the thickness of the male tubular component $e_p$ at the end of the threaded zone being greater than the thickness of the female tubular component $e_b$.

The relative difference between the lead of the male stabbing flanks and/or load flanks and the lead of the female stabbing flanks and/or load flanks is in the range 0.15% to 0.35%.

The relative difference between the lead of the male stabbing flanks and/or load flanks and the lead of the female stabbing flanks and/or load flanks is substantially equal to 0.25%.

The threaded zones each have a taper generatrix forming an angle with the axis of revolution of the tubular components.

The thread crests and roots are parallel to the axis of revolution of the tubular component.

The threads of the male and female tubular components have a dovetail profile.

The invention also concerns a threaded connection resulting from screwing a set in accordance with the invention by self-locking make up.

In accordance with certain characteristics, the male and/or female thread crests have an interference fit with the roots of the female and/or male threads.

In accordance with other characteristics, the threaded connection is a threaded connection of a drilling component.

The characteristics and advantages of the invention are set out in more detail in the following description, made with reference to the accompanying drawings.

Figure 1:
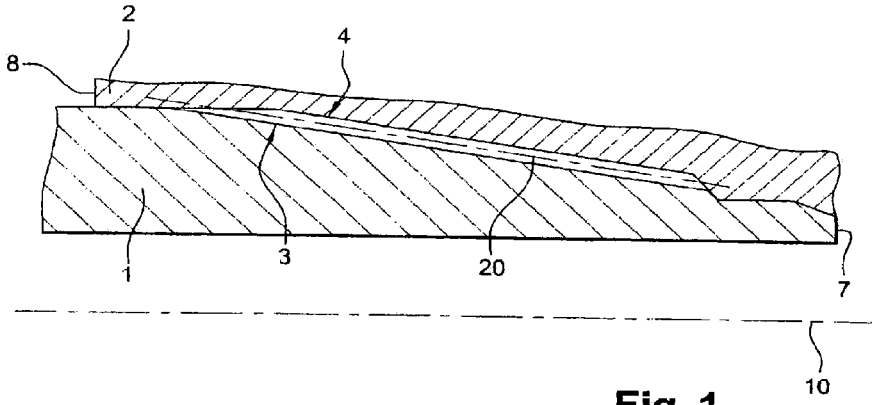
FIG. 1 is a diagrammatic view in longitudinal cross section of a connection resulting from connecting two tubular components by self-locking make-up, in accordance with one embodiment of the invention.

The threaded connection shown in FIG. 1 with axis of revolution 10 comprises, in known manner, a first tubular component with the same axis of revolution 10 and provided with a male end 1 and a second tubular component with the same axis of revolution 10 and provided with a female end 2. The two ends 1 and 2 each finish in a terminal surface 7, 8 which is orientated radially with respect to the axis 10 of the threaded connection and are respectively provided with threaded zones 3 and 4 which cooperate together for mutual connection of the two components by make-up. The threaded zones 3 and 4 are of a known type defined as "self-locking" (also said to have a progressive variation of the axial width of the threads and/or the intervals between threads), such that progressive axial interference occurs during make-up until a final locking position is reached.

Figure 2:
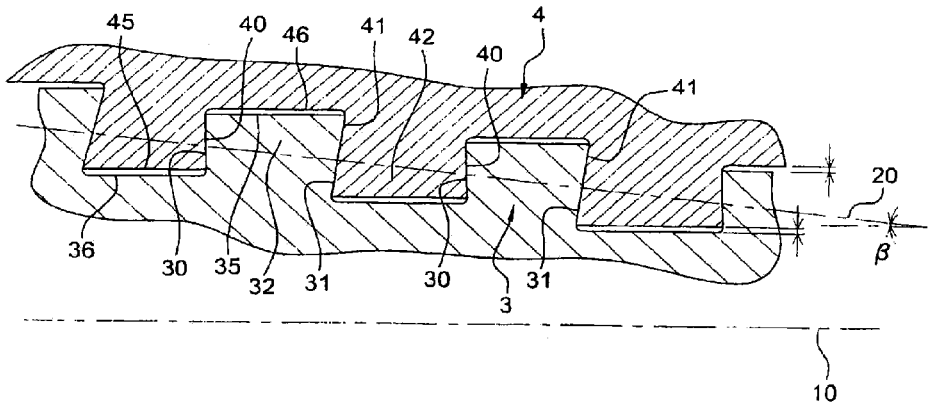
FIG. 2 is a detailed diagrammatic view in longitudinal section of the threaded zones of the connection of FIG. 1.
Figure 3:
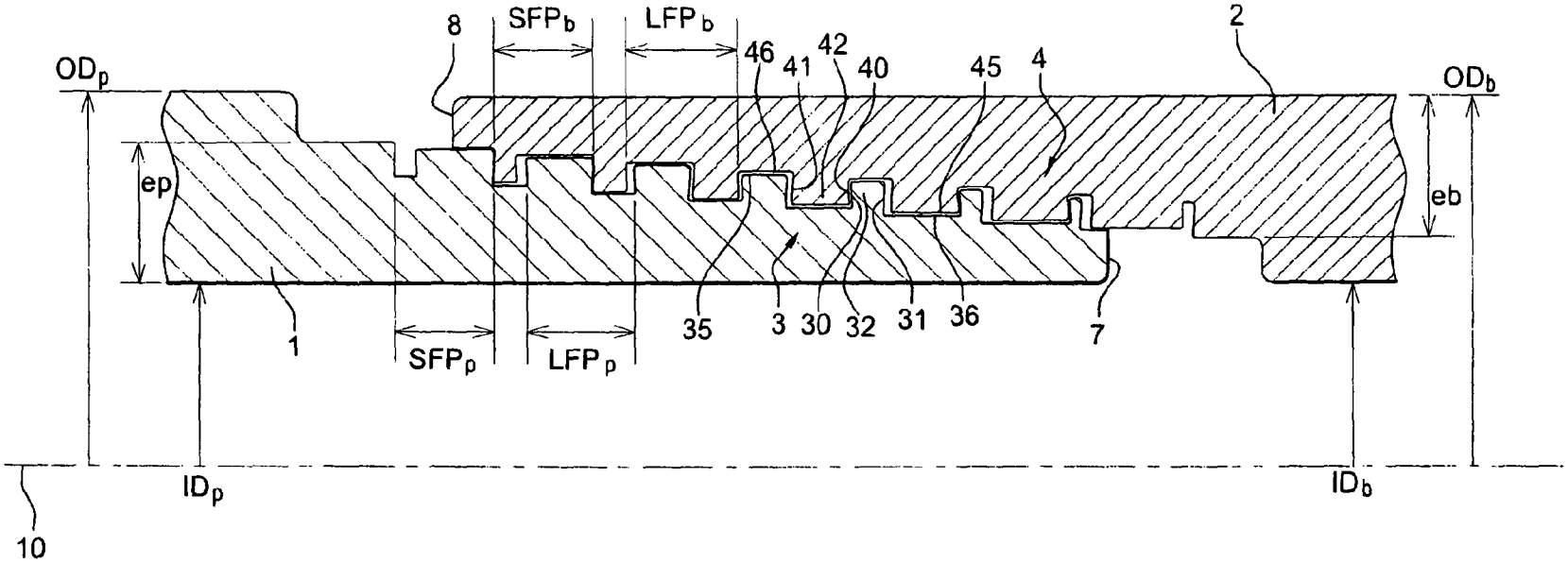
FIG. 3 is a diagrammatic longitudinal sectional view of two tubular components in accordance with the invention during connection by self-locking make-up.
Figure 4:
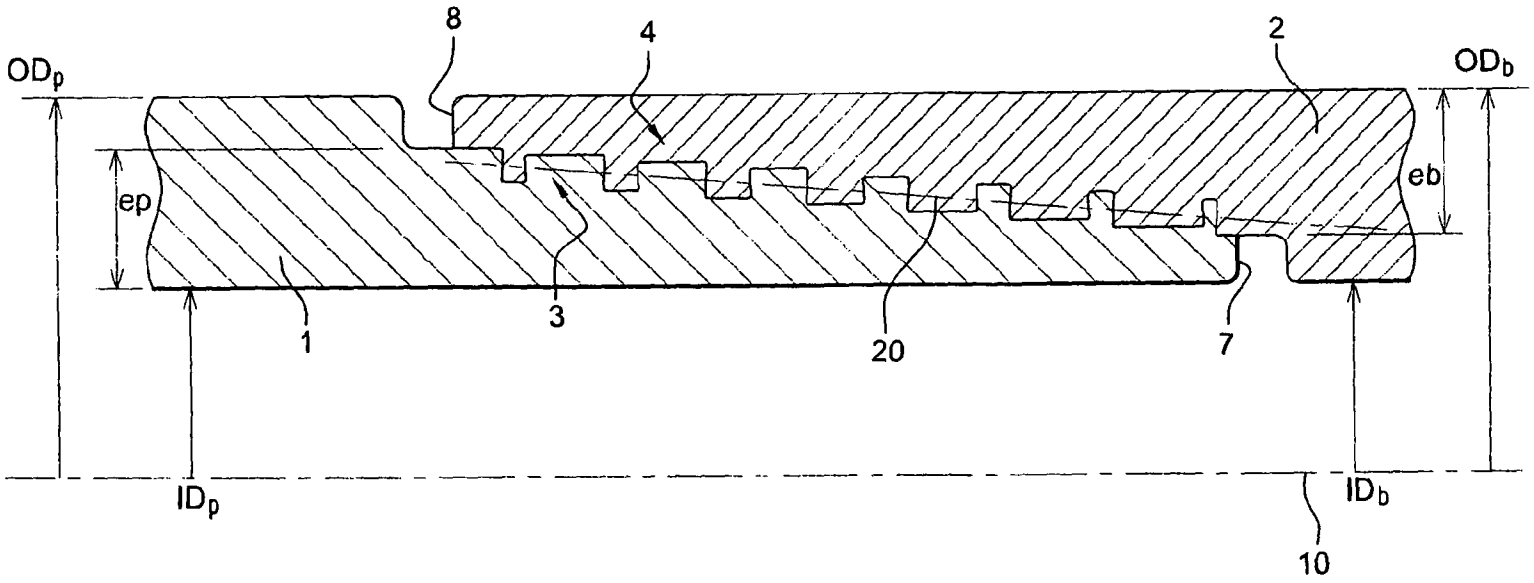
FIG. 4 is a diagrammatic view in longitudinal section of two tubular components in accordance with the invention at the end of self-locking make-up.
Figure 5A:
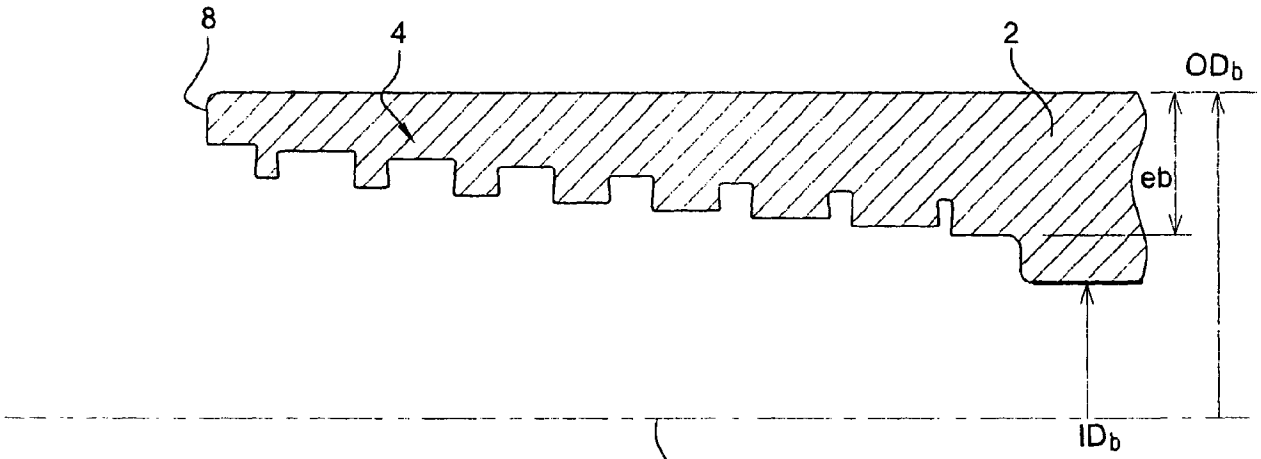
FIGS. 5A and 5B are each diagrammatic views in longitudinal section of respectively a male tubular component and a female tubular component in accordance with the invention.
Figure 5B:
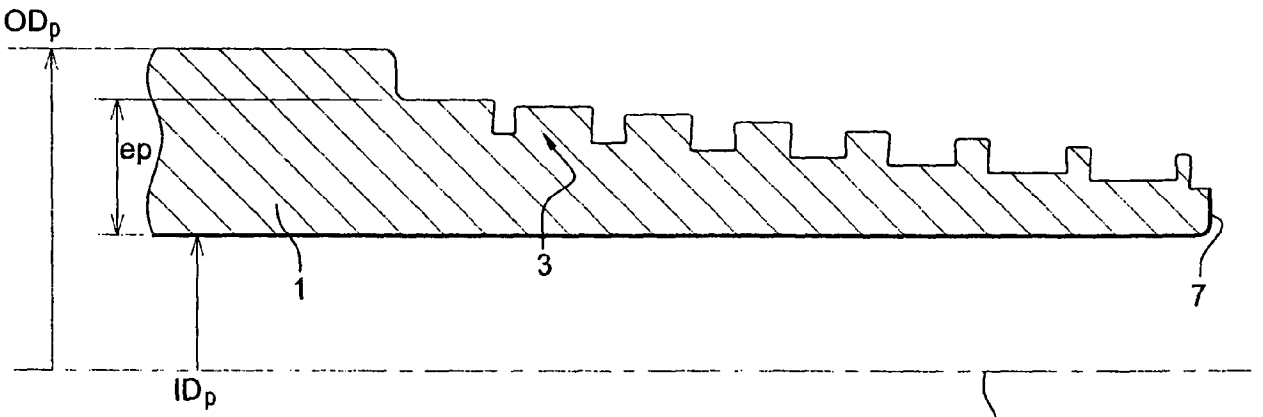

FIGS. 2, 3 and 4 represent self-locking threaded zones and use identical reference numerals. FIG. 2 is a detailed diagrammatic longitudinal sectional view of the threaded zones of the connection of FIG. 1. The term "self-locking threaded zones" means threaded zones including the features detailed below. The male threads (or teeth) 32, like the female threads (or teeth) 42, have a constant lead while their width decreases in the direction of their respective terminal surfaces 7, 8, such that during make-up the male 32 and female 42 threads (or teeth) finish by locking into each other in a determined position. More precisely, the lead LFPb between the load flanks 40 of the female threaded zone 4 is constant, as is the lead SFPb between the stabbing flanks 41 of the female threaded zone, wherein a particular feature is that the lead between the load flanks 40 is greater than the lead between the stabbing flanks 41.

Similarly, the lead SFPp between the male stabbing flanks 31 is constant, as is the lead LFPp between the male load flanks 30, a particular feature being that the lead between the load flanks 30 is greater than the lead between the stabbing flanks 31.

In accordance with the invention and as can be seen in FIG. 3, the leads between the stabbing and/or load flanks, male and female, are not equal to each other. More precisely, in accordance with one envisaged embodiment, the respective leads SFPp and SFPb between the male 31 and female 41 stabbing flanks are not equal to each other and the respective leads LFPp and LFPb between the male 30 and female 40 load flanks are also not equal to each other.

In the case in which the lead of the load flanks LFPp of the male threaded zone 1 is greater than the lead of the load flanks LFPb of the female threaded zone 2, then during the make-up operation, the load flanks of the male and female threaded zones come into contact earlier in the region of the female terminal surface 8 than in the case of a conventional connection where the leads of the male and female load flanks are equal.

Similarly, in the case in which the lead of the stabbing flanks SFPp of the male threaded zone 1 is greater than the lead of the stabbing flanks SFPb of the female threaded zone 2, then during the make-up operation, the stabbing flanks of the male and female threaded zones come into contact earlier in the region of the male terminal surface 7 than in the case of a conventional connection where the leads of the male and female load flanks are equal.

In contrast, in the case in which the lead of the load flanks LFPp of the male threaded zone 1 is smaller than the lead of the load flanks LFPb of the female threaded zone 2, then during the make-up operation, the load flanks of the male and female threaded zones come into contact later in the region of the female terminal surface 8 than in the case of a conventional connection where the leads of the male and female load flanks are equal.

Similarly, in the case in which the lead of the stabbing flanks SFPp of the male threaded zone 1 is smaller than the lead of the stabbing flanks SFPb of the female threaded zone 2, then during the make-up operation, the stabbing flanks of the male and female threaded zones come into contact later in the region of the male terminal surface 7 than in the case of a conventional connection where the leads of the male and female load flanks are equal.

Thus, if a configuration is selected in which the lead of the load flanks LFPp and the lead of the stabbing flanks SFPp of the male threaded zone 1 are respectively greater than the lead of the load flanks LFPb and the lead of the stabbing flanks SFPb of the female threaded zone 2, the excess lubricant is evacuated out of the connection at the end of make-up.

In fact, as the make-up operation progresses, since the stabbing flanks in the region of the male terminal surface rapidly come into contact, i.e. the clearance between said stabbing flanks reduces more quickly than in a conventional connection, excess lubricant is expelled towards the outside of the connection. Further, when this excess lubricant reaches the region of the female terminal surface, since the load flanks rapidly come into contact, i.e. the clearance between said load flanks reduces more quickly than in a conventional connection, the excess lubricant is evacuated towards the outside.

Similarly, if a configuration is selected in which the lead of the load flanks LFPp and the lead of the stabbing flanks SFPp of the male threaded zone 1 are respectively smaller than the lead of the load flanks LFPb and the lead of the stabbing flanks SFPb of the female threaded zone 2, the excess lubricant is evacuated into the interior of the connection at the end of make-up.

In all cases, the problem of reading of the make-up torque being rendered false by the excess of lubricant is overcome by facilitating evacuation of the excess lubricant.

Further, the configuration in which the lead of the load flanks and the lead of the stabbing flanks of the male threaded zone are greater than the lead of the load flanks and the lead of the stabbing flanks of the female threaded zone also presents another aspect.

The increase in the contact forces in these regions close to the terminal surfaces tends to "lengthen" the male end and "shorten" the female end. It should be noted that friction caused by contact pressure on these flanks results in an additional source of torque on the connection.

Further, when the connection operates in tension, the contact pressure on the load flanks increases and the contact pressure on the stabbing flanks decreases. The problem is that the contact pressure tends to cancel out at the female stabbing flanks located in the region of the male terminal surface 7. This in fact weakens the threaded zone in terms of fatigue.

However, since the contact pressure is higher on the stabbing flanks close to the male terminal surface 7 and the contact pressure is lower on the load flanks close to the female terminal surface 8, the fatigue strength is thus increased on the female end 2 and reduced on the male end 1.

Thus, it appears that choosing to over-dimension the lead of the flanks of the male end compared with the lead of the flanks of the female end or vice versa depends on the design of the connection and more particularly on the thickness of the male end female ends. Thus, if the thickness ep of the male end 1, defined not by the difference between the external diameter ODp and the internal diameter IDp but by the base of the threaded zone 3, is smaller than the thickness eb of the female end 2, defined not by the difference between the external diameter ODb and the internal diameter IDb but by the base of the threaded zone 4, then the fatigue strength of the male end 1 is to be increased (to the detriment of the fatigue strength of the female end) by under-dimensioning the leads of the flanks of the male end with respect to the respective leads of the female end. In contrast, if the thickness ep of the male end 1 is greater than the thickness eb of the female end 2, the fatigue strength of the female end 2 is to be increased (to the detriment of the fatigue strength of the male end 1) by over-dimensioning the leads of the flanks of the male end with respect to the respective leads of the female end.

Advantageously, the relative difference between the lead of the male stabbing flanks and/or load flanks and the lead of the female stabbing flanks and/or load flanks is in the range 0.15% to 0.35%.

Advantageously, the relative difference between the lead of the male stabbing flanks and/or load flanks and the lead of the female stabbing flanks and/or load flanks is substantially equal to 0.25%.

As can be seen in FIG. 2, and advantageously, the male and female threads (or teeth) have a profile, viewed in longitudinal section passing through the axis 10 of the threaded connection, which has the general appearance of a dovetail such that they are solidly fitted one into the other after make-up. This additional guarantee means that risks known as "jump-out", corresponding to the male and female threads coming apart when the connection is subjected to large bending or tensile loads, are avoided. More precisely, the geometry of the dovetail threads increases the radial rigidity of their connection compared with threads which are generally termed "trapezoidal" with an axial width which reduces from the root to the crest of the threads.

Advantageously and as can be seen in FIG. 2, the threadings 3 and 4 of the tubular components are orientated along a taper generatrix 20 so as to facilitate the progress of make-up. In general, this taper generatrix forms an angle β with the axis 10 which is included in a range from 1 degree to 5 degrees. In the present case, the taper generatrix is defined as passing through the middle of the load flanks.

Advantageously and as can be seen in FIG. 2, the teeth crests and the teeth roots of the male and female threaded zones are parallel to the axis 10 of the threaded connection. This facilitates machining. The teeth crest 35 of the male threaded end have an interference fit with the teeth root 46 of the female threaded end after reaching a self-locking make-up position. The teeth crest 45 of the female threaded end have an interference fit with the teeth root 36 of the male threaded end after reaching the self-locking make-up position.

Thus, the threaded connection resulting from assembling tubular components in accordance with the invention is obtained with a make-up torque in accordance with prevailing standards. This type of connection is used in particular in drilling applications. Advantageously, the male and/or female thread crests may have an interference fit with the roots of the female and/or male threads. This means that trapping of the lubricant can be avoided since it is expelled towards the thread flanks during make-up.

The invention claimed is:

1. A threaded connection, comprising:

a first tubular component and a second tubular component each with an axis of revolution, the first tubular component comprising a male threaded end including a threaded zone formed on an external peripheral surface of the first tubular component and the second tubular component comprising a female threaded end including a threaded zone formed on an internal peripheral surface of the second tubular component, both the male threaded end and the female threaded end finishing in a terminal surface, the threaded zones comprising, over a portion defined as in a self-locking make-up, threads, which before the self-locking make-up and when viewed in a longitudinal section passing through the axis of revolution of the first and second tubular components, each comprising:

a thread crest, a thread root, a load flank, and a stabbing flank, a width of the thread crests of each of the first and second tubular components reducing in a direction of the terminal surface of the tubular component under consideration, while a width of the thread roots increases, wherein at least one of a lead of the stabbing flanks of the male threaded end is respectively different from a lead of the stabbing flanks of the female threaded end, and a lead of the load flanks of the male threaded end is respectively different from a lead of the load flanks of the female threaded end, the leads of the flanks remaining constant over the portion defined as in the self-locking make-up.

2. The threaded connection according to claim 1, wherein at least one of the lead of the male stabbing flanks is respectively smaller than the lead of the female stabbing flanks, and the lead of the male load flanks is respectively smaller than the lead of the female load flanks, a thickness of the first tubular component at an end of the threaded zone opposite the terminal surface being less than a thickness of the second tubular component.

3. The threaded connection according to claim 1, wherein at least one of the lead of the male stabbing flanks is respectively greater than the lead of the female stabbing flanks, and the lead of the male load flanks is respectively greater than the lead of the female load flanks, a thickness of the first tubular component at an end of the threaded zone opposite the terminal surface being greater than a thickness of the second tubular component.

4. The threaded connection according to claim 1, wherein at least one of a relative difference between the lead of the male stabbing flanks and the lead of the female stabbing flanks is in a range of 0.15% to 0.35%, and a relative difference between the lead of the male load flanks and the lead of the female load flanks is in the range of 0.15% to 0.35%.

5. The threaded connection according to claim 1, wherein at least one of a relative difference between the lead of the male stabbing flanks and the lead of the female stabbing flanks is substantially equal to 0.25%, and a relative difference between the lead of the male load flanks and the lead of the female load flanks is substantially equal to 0.25%.

6. The threaded connection according to claim 1, wherein the threaded zones each have a taper generatrix forming an angle with the axis of revolution of the first and second tubular components.

7. The threaded connection according to claim 1, wherein the thread crests and roots are parallel to the axis of revolution of the first and second tubular components.

8. The threaded connection according to claim 1, wherein the threads of the first and second tubular components have a dovetail profile.

9. The threaded connection according to claim 1, wherein at least one of the male and female thread crests have an interference fit with the roots of at least one of the female and male threads after the self-locking make-up.

10. The threaded connection according to claim 1, wherein the threaded connection is a threaded connection for a drilling component.

11. The threaded connection according to claim 1, wherein both the lead of the male stabbing flanks is respectively different from the lead of the female stabbing flanks and the lead of the male load flanks is respectively different from the lead of the female load flanks.

* * * * *